US005292107A

United States Patent [19]

Chick

[11] Patent Number: 5,292,107

[45] Date of Patent: Mar. 8, 1994

[54] SEWER COVER LIFTING TOOL

[76] Inventor: Gerald T. Chick, 389 State Rd., Eliot, Me. 03903

[21] Appl. No.: 952,997

[22] Filed: Dec. 11, 1992

[51] Int. Cl.[5] ..... B66F 11/00

[52] U.S. Cl. ..... 254/131

[58] Field of Search ..... 294/15, 17, 91, 62, 294/63 B; 254/120–123, 131, 131.5, 132, 129; 414/684.3, 444; 450/457; 280/47.27

[56] References Cited

U.S. PATENT DOCUMENTS

| | | | |
|---|---|---|---|
| 3,985,338 | 10/1976 | Herrmann | 254/131 |
| 4,662,607 | 5/1987 | Mochizuki et al. | 254/131 |
| 4,826,388 | 5/1989 | Golding | 254/131 |
| 4,978,103 | 12/1990 | Molsan | 254/131 |

*Primary Examiner*—Robert C. Watson
*Attorney, Agent, or Firm*—Laforest S. Saulsbury

[57] ABSTRACT

A wheeled hand lever tool for lifting, transporting and installing heavy sewer covers that will lift the cover from its side edge. In one form, a T-fitting lifts from an elongated slot through holes in the cover allowing the cover to tilt forwardly for its edge to engage a stop plate on the tool so that the cover is rigidly held by gravity upon the tool. To have added lift advantage, a depending ground-engaging fulcrum is located forwardly of its wheels. For peripherally-notched covers direct engagement is had with diametrically-opposite notches by use of a secondary lifting arm that is lowered from the lifting arm of the tool.

9 Claims, 4 Drawing Sheets 27
26'
21
26
65
29
22
23'
23
71
31
67'
57
54'
56
54
21'
65
69
53'
36
24
52
28
33
42
32

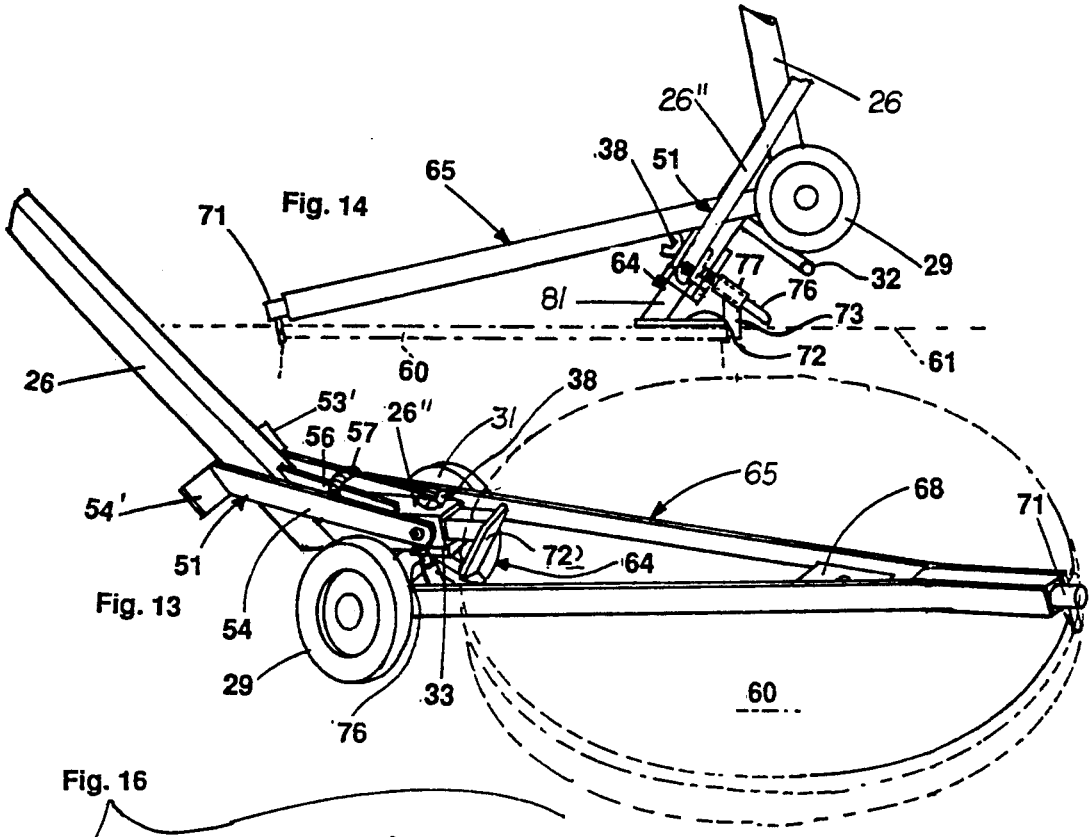
Fig. 14
Fig. 13
Fig. 16
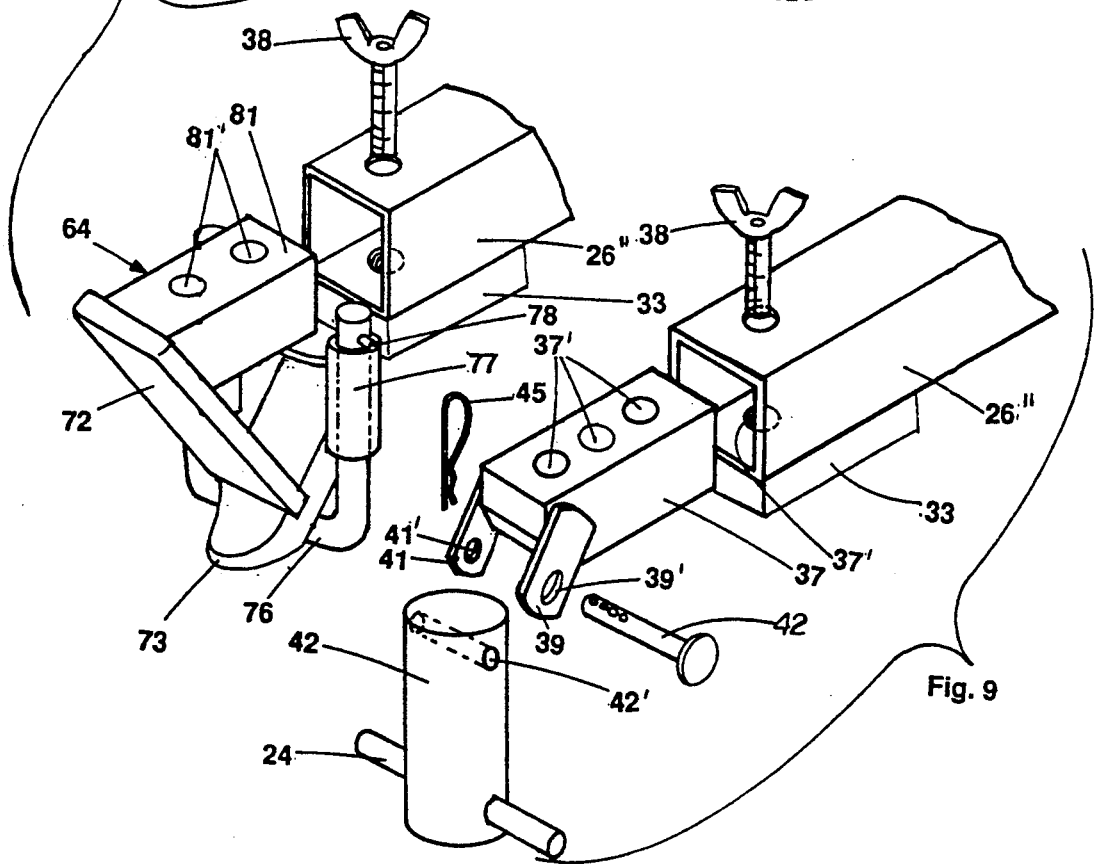
Fig. 9

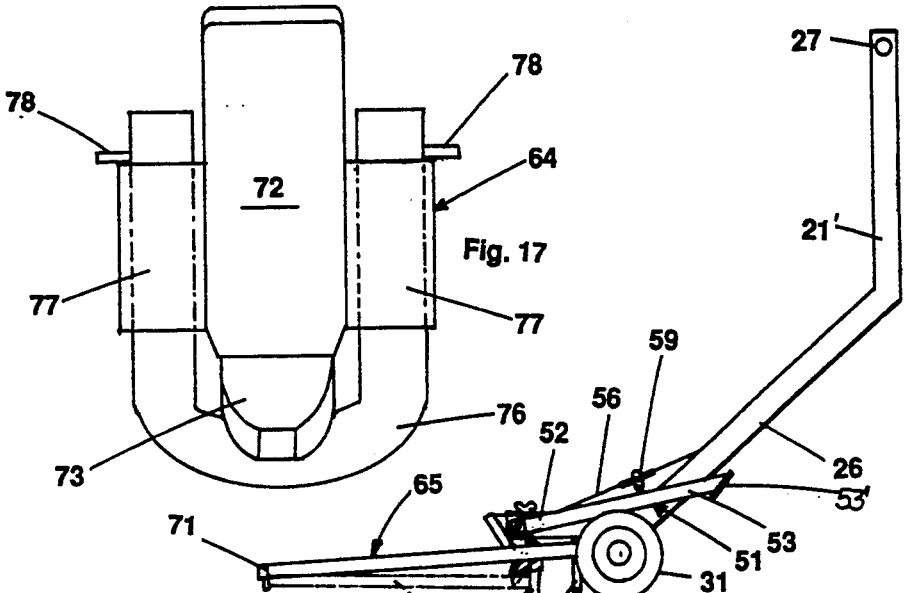
Fig. 17
Fig. 15
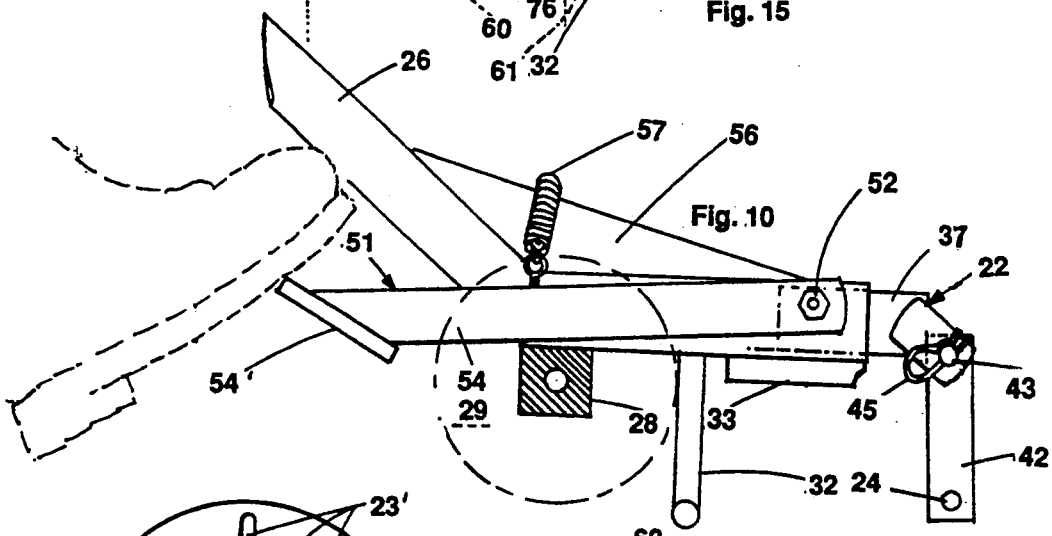
Fig. 10
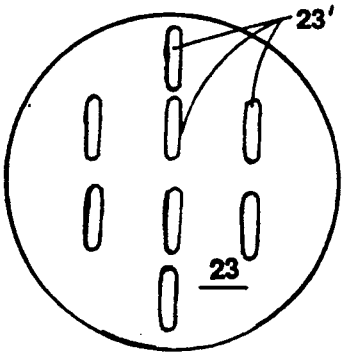
Fig. 11
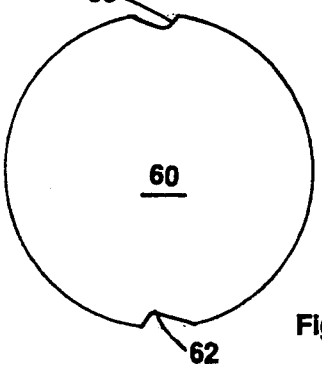
Fig. 12

SEWER COVER LIFTING TOOL

This invention relates to a hand lever tool for lifting transporting and installing heavy storm drain and sewer covers of the standard type now in general use.

Workmen many times lift these covers and often seriously injure their hands and feet. Various lifting arrangements have been used for bodily axially lifting covers as seen in U.S. Pat. Nos. 4,157,800, 4,279,356 and 4,482,182, but they have not been adapted for standard-type covers, and no provisions have been made for wheeled transportation of the lifted covers to distant locations from the road surface of the street. Also, the prior art fails to show a tool that by mere engagement with the outer edge of the standard cover can lift and transport the cover from its opening.

The present invention generally comprises a hand lever supported on wheels and adapted by use of detachable fittings to engage the outer edge of respective various standard-type covers and a depending ground-engaging fulcrum located forwardly of the wheels on which the initial lifting action is effected and onto the wheels for further lifting and transport to a distant location. To provide for engagement with a storm drain cover, use is made of its elongated holes for securement of a pivotal T-fitting attachment with cover just inwardly of the outer edge so that the edge swings backward for engagement with a horizontal stop plate thereby to tiltably retain the lifted cover for transport upon the supporting wheels.

For engagement of a sewer cover having only diametrically-opposed notches in its peripheral edge, a long arm is pivoted downwardly from the tool lifting arm for clamping engagement with the notch at the remote side of the cover while from a special detachable fitting on the tool lever arm has clamping engagement with the near notch on the cover. Further fittings for other standard covers may be developed and attached to the lifting lever for use therewith and effective to lift from but one edge or side of the cover.

Accordingly, it is the principal object of the invention to provide a hand lever tool for lifting, transporting and installing standard storm drain and sewer covers from and upon their openings which can be attached to the outer edge and one side of the cover and effective thereupon for lifting and transporting the cover.

It is another object of the invention to provide a wheel hand lever tool for lifting and transporting standard storm drain and sewer covers having a head adapted for detachably receiving various fittings suitable for use with respective different standard types of covers.

It is another object of the invention to provide a wheeled hand lever tool for lifting and transporting storm drain and sewer covers having a ground-engaging fulcrum depending tool forwardly of its wheels for the initial lifting of the cover from its opening and onto its wheels for transportation.

It is still another object of the invention to provide a T-fitting for a hand lever tool for lifting and transporting storm drain and sewer covers adapted to be angled into an elongated slot located inwardly of the edge of the cover while allowing the lifted cover to tilt forwardly for engagement of the edge with a horizontal stop plate to retain the cover while being finally lifted and transported.

It is still another object of the invention to provide a hand lever tool for lifting and transporting storm drain and sewer covers having a fitting adapted to engage peripheral notches in the cover and an arm adapted to be lowered from the main tool arm to engage with the remote cover edge diametrically-opposite from the one notch for clamping action therebetween while the cover is being bodily lifted by the hand tool.

It is a further object of the invention to provide a wheeled hand lever tool for lifting and transporting storm drain and sewer covers from their openings that has a bent up handle portion that extends to waist high upon the use of the tool while the main portion of the lever is lowered for lifting and transport to easily maintain a lifting grip upon the cover.

It is a still further object of the invention to provide a wheeled hand lever tool for lifting and transporting storm drain and sewer covers from their openings with a depressable foot lever to increase the lever action used in the lifting of the cover.

Still further objects of the invention are to provide, with the above objects in mind, a hand lever tool for lifting, transporting and installing storm drain and sewer covers from and to their openings, which is of simple rigid construction, has a minimum number of parts, easy to assemble, handled with little effort, permits easy interchange of various cover engaging attachments, has simple and effective engagement with the covers, positive and increased lever action, easily adjusted to different size and types of covers, free of moveable parts, pleasing appearance and efficient in operation.

For a better understanding of the invention, reference may be had to the following detailed description taken in connection with the accompanying drawings, in which FIG. 1 is a top perspective view of the storm drain and sewer cover lifting and transporting tool embodying features of the present invention with its T-fitting connected to a storm drain type cover broken from its opening and ready for transport therefrom, FIG. 2 is an illustrative view showing how the lifter is initially attached to the cover with the T-fitting extended through an elongated drain slot prior to being angled thereunder.

FIG. 9 is an exploded view of the T-fitting with each of its parts shown in perspective and detachably extended from a forward fragment of the main hand lever.

FIG. 10 is an enlarged fragmentary elevational view looking upon a depressable foot lever used to assist in the initial lifting operation that breaks away the cover from its opening.

FIG. 11 is a plan view of a storm drain cover with its elongated drain holes therein.

FIG. 12 is a plan view of a sewer cover having diametrically-opposed notches in its peripheral edge for engagement of the lifting tool therewith.

FIG. 13 is a fragmentary perspective view of the lifting tool having the attachment for lifting a sewer cover from its diametrically-opposed notches thereof and with its secondary lifting arm lowered for engagement of its clamping pin with the notch on the far side of the cover from the lifting lever and the cover broken away from its opening.

FIG. 14 is a fragmentary side elevational view of the lever tool up ended for its initial engagement with the sewer cover.

FIG. 15 is a side elevational view with the hand lever lifting tool fully engaged with the cover and the cover lifted from its opening.

FIG. 16 is an exploded view of the fitting used on the hand lifting lever for use with the sewer cover, each of its parts being enlarged and shown in perspective and extended from a fragment of the hand lever.

FIG. 17 is a front elevational view of the fitting as illustrated in FIG. 16,

Figures 1, 2, 3, 4, 5:
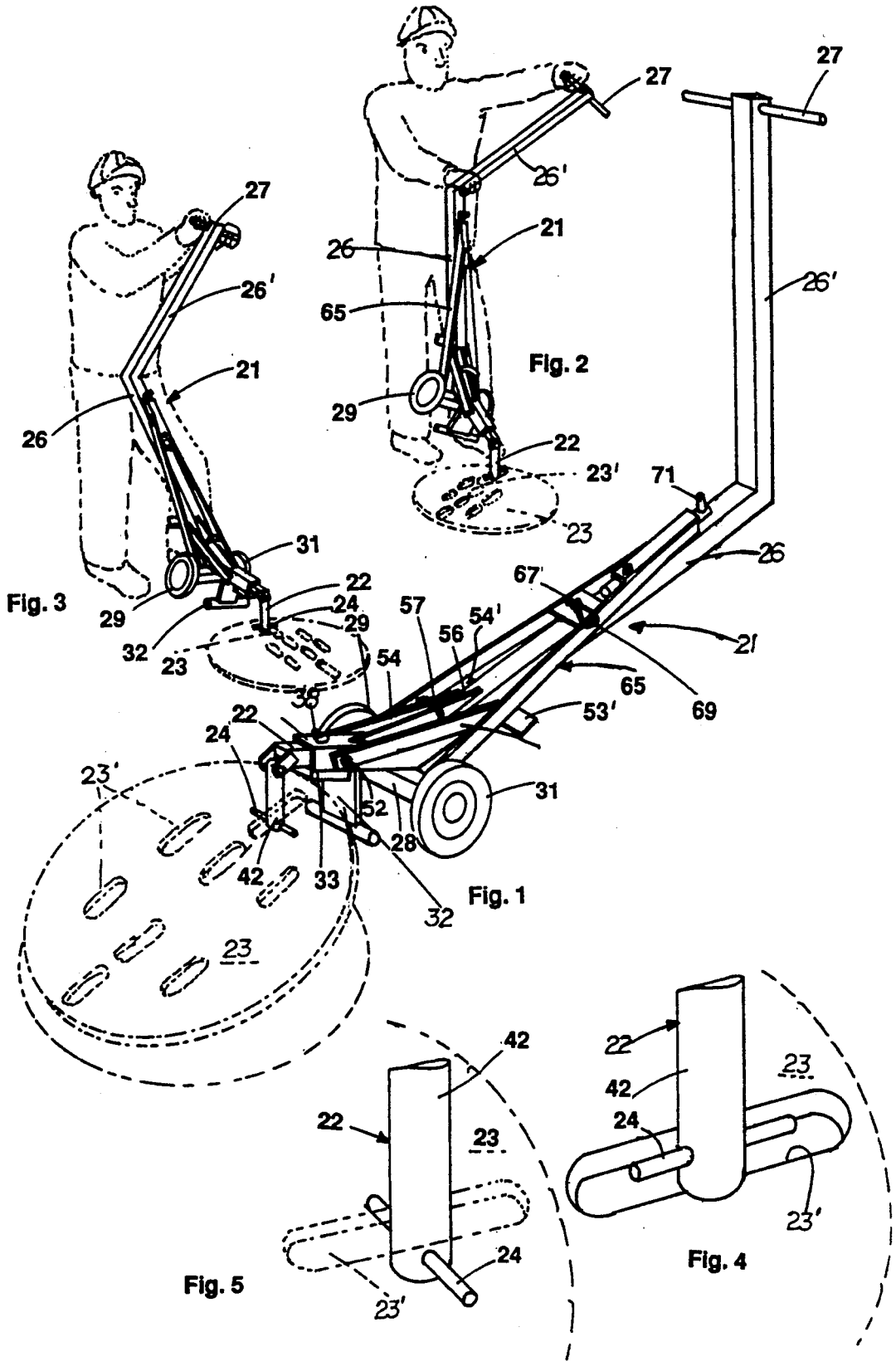
FIG. 3 is an illustrative view similar to FIG. 2, after the lifting tool has been angled to align the T-fitting with the undersurface of the cover for lifting engagement therewith.
FIG. 4 is an enlarged fragmentary view of the T-fitting being extended into an elongated cover slot, as illustrated in FIG. 2.
FIG. 5 is a similar enlarged fragmentary view of the T-fitting after it has been extended through the slot and angled or turned for engagement with the undersurface of the cover, as illustrated in FIG. 3

Referring now to the figures, and particularly to FIGS. 1-10, there-is shown the cover lifting tool 21 to which a detachable T-fitting 22 has been attached for the lifting and transport of a storm drain cover 23 having elongated holes or slots 23' and into which there is extended as in the manner illustrated in FIGS. 2 and 4 by the holding of the cover lifting tool vertically to lower the T-fitting axially through the cover elongated holes 23' so that its transverse member 24 as the tool turned through 90-degrees engages with the undersurface of the cover all as illustrated in FIGS. 2, 3, 4 and 5. While the T-fitting 22 is used for a storm drain cover, it can be replaced by another fitting for use upon a sewer type cover having but diametrically-opposite peripheral notches such as will be later described.

The lifting tool of itself without the fittings comprises generally an elongated arm 26 that has a bent upward handle extension 26' with a cross handle 27. The lifting arm 26 is of square hollow section and its upturned head end 26", to which is welded a cross body member 28 on the respective opposite transverse ends of which wheels 29 and 30 are respectively journalled. The wheels will engage the ground after the lifting arm 24 has been pivoted upon a depending ground engaging fulcrum pivot 32 lying in advance of the wheels and closer to the cover 23" to increase the leverage and to lift the cover onto the wheels 29 and 31 for transportation to any remote location once it has been lifted from its opening. Much more leverage will have been obtained with the advance pivot 32 than from the wheels to make for an easy break away of cover from its opening. With the lifting arm 26 being lowered, the cover 23 is broken away and lifted from its opening by the T-fitting attachment and will tilt down so that its rear peripheral edge will engage with a stop plate 33 on the underside of an upwardly-inclined head extension 26" of the square section lifting lever arm 26 in the end of which the T-fitting 22 is adjustably retained.

The T-fitting attachment 22 is best seen in the exploded view of FIG. 9-which includes a square attaching block 37 having adjusting holes 37' and that is slideable into the open end of the lifting arm extension 26" and secured in place by a thumb screw 38 and threaded into a threaded hole 37' to the bottom face of the extension 26" stop plate 33 is serviced. On the block 37 are forwardly and downwardly spaced projections 39 and 41 with respective holes 39' and 41' of the projections 39 and 41 axially aligned to receive pivot pin 43 that is retained against axial displacement by a cotter pin 45 for pivotal connection of T-fitting shaft 42 extending through hole 42'. The shaft 42 is extended through the cover hole 23' as best seen in FIG. 4 and upon being turned for engagement with the undersurface of the cover and lifted, breaks away the cover 23 from its opening and swings rearwardly with the cover 23 for engagement of its peripheral edge with the stop plate 33.

Once the full engagement has been made of the transverse shaft 24 with the cover 23, the lifting arm 26 is lowered and the initial lifting is made about the depending ground-engaging fulcrum or pivot 32 lying in advance of the wheels 29 and 31 so that the cover is first lifted from one edge and as the lifting arm 26 is lowered the cover is picked up so that it will swing down in a manner that its peripheral edge will engage with the stop plate 33 so that a full lift connection of the cover by the lifting tool will have been effected to transport the cover upon the wheels 29 and 31. The lifting arm 26 is held in its full lowered position as seen in FIG. 1 and the cover will have been lifted onto the wheels 29 and 31 ready to be transported to any distant location. So long as the lifting arm 26 is retained in its lowered position by holding down with the cross handle 27 on its up ended portion 26', the engagement of the cover with the lifting arm remains. The bent upward portion 26' thus provides a convenient manner by which the arm 26 can be held easily in its lowered position from waist height while the lifting tool is wheeled away with the cover attached.

On the initial lifting action to break away the cover from its opening and to provide further leverage about the gaging pivot 32, a foot depressable lever device 51, as illustrated best in FIG. 10, that is pivotly connected forwardly on the lever arm portion 26" at 52 and comprises two arms 53 and 54 on the respective sides of the arm portion 26" to the free ends of which there is laterally-extended respective cross foot engaging portions 53' and 54' which a foot engages as illustrated in FIG. 10 so that it will bear upon the cross body member 28 to add lifting action to the lifting tool while at the same time it is being levered by its lever arm 26 and its cross handle 27. Extending upwardly from the lifting arm portion 26" is a gussett 56 over which is extended a return tension spring 57 having its opposite ends respectively connected with the respective pivot arms 53 and 54. Upon release of the foot from the lever device 51 the lever assembly is returned to its raised position by the tension spring 57 with the cross foot engaging portions 53' and 54' engaging with the undersurface of the lifting arm 26 to limit the upward return movement.

Referring now particularly to FIGS. 12 to 17, there is shown the lifting tool adapted for use upon a sewer cover 60 having notches 62 and 63 diametrically-opposed to each other in the peripheral edge of the cover FIG. 16. The basic lifting tool 21 will now accordingly be used with a special fitting assembly 64. This fitting 64 simply replaces the T-fitting assembly 22 above described and likewise is detachable as best seen in FIG. 9.

Figure 6:
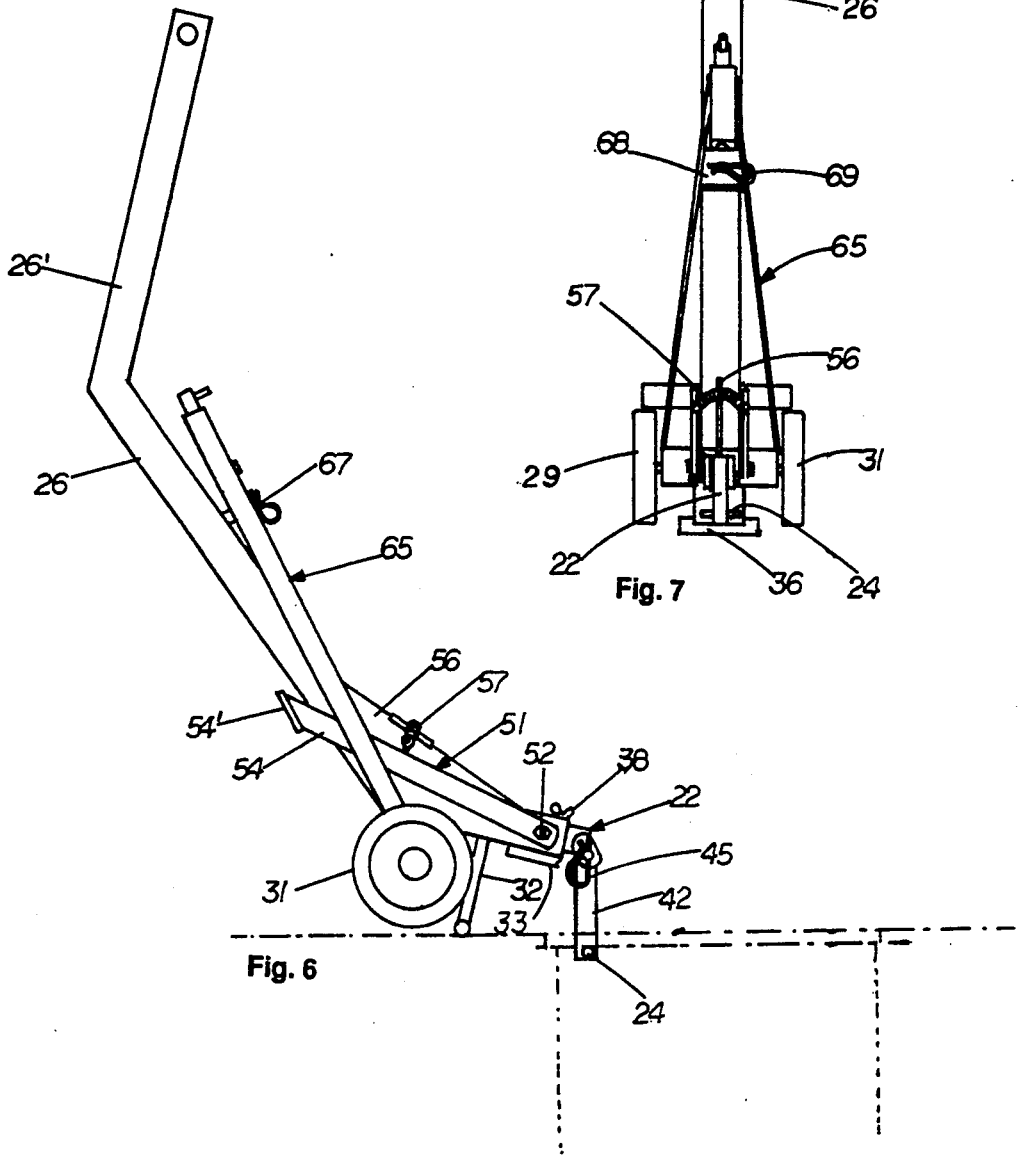
FIG. 6 is a side elevational view of the lifting tool, connected with the cover and resting upon its ground engaging fulcrum with wheels raised preparatory to the lifting of the cover.
Figure 7:
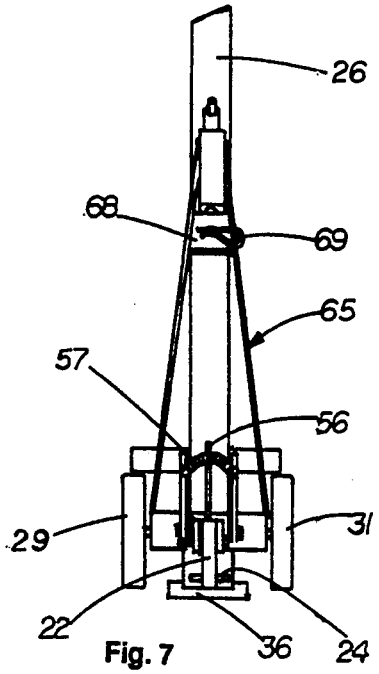
FIG. 7 is a front elevational view of the lifting tool free of the drain cover.
Figure 8:
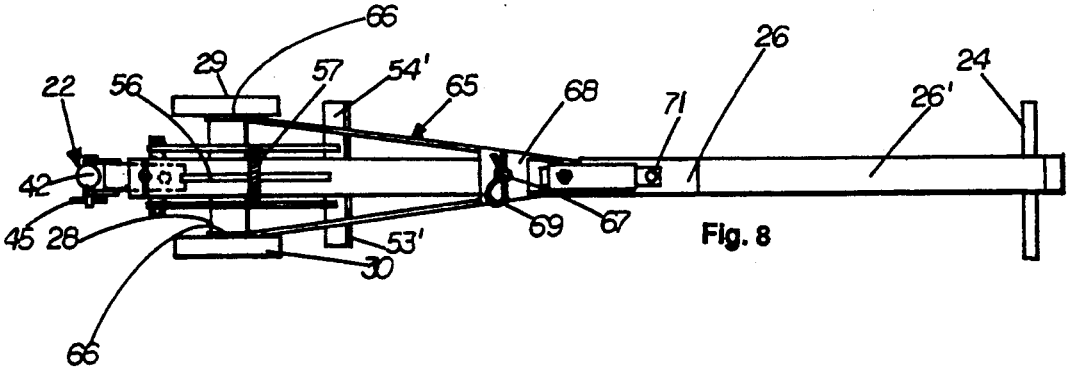
FIG. 8 is a top plan view thereof.

In order to reach across the cover plate for engagement with the remote notch 63, a second and auxiliary arm assembly 65 normally carried by the lifting tool 21 is pivoted down about its pivot connection 66 with the cross body member 28 for use, FIGS. 6, 7 and 8. Normally, this arm assembly 65 is retained on the top face of the lifting arm 26 by a pin projection 67 on the lifting arm 26 that will extend through a cross plate 68 on the arm assembly 65 and releaseable by removing the cotter pin 69 from the lifting arm pin projection 67. The outer end of the lifting arm 65 has a clamp pin 71 assembly axially adjustable for engagement with the remote notch 63 of the notched sewer cover 60, FIG. 12.

This lowering of the lifting arm 65 will be effected as illustrated in FIGS. 13 and 14 after the lifting tool has been placed upon the cover 60 so that it extends over the edge of the cover upon its support plate 72 so that its clamp projection 73 will enter the near notch 62 of the cover 60. With the pin assembly 71 of the axially lifting arm 65 engaging the remote notch 63 and pin projection 73 engaging the near notch 62 and with the lifting arm 26 then pivoted down upon its ground-engaging fulcrum Pivot 32, the lifting of the cover 60 from its opening is effected. The cover 60 as the lowering of the lifting tool is made will be wedged and clamped between the pin assembly 71 and pin projection 73 for its bodily removal from its opening. The pin projection 73 is adapted to have a smooth fit with the notch 62, but in order to insure its engagement therewith the lifting tool arm 26 must be held in its downwardly pivoted position upon the wheels 29 and 31.

Within the special fitting assembly 64, there is provided a slideable U-shaped member 76 extended across and underneath the pin projection 73 and having its respective legs respectively slideably retained within respective spaced sleeves 77 free slideably retained by pins 78, FIG. 16. The U-shaped member 76 will by gravity locate itself in engagement with the top of the sewer opening about the cover plate 60 as indicated at 61, FIGS. 13, 14 and 15 and the downward lever action of the foot lever device 52 will depress the U-shaped member against the top of the sewer opening to pop the cover 60 from its opening. Thus, with the pin projections 71 and 73 engaging entirely within the notches 62 and 63 of the cover 60, while the U-shaped member 76 will slide into position beside the edge of the cover to push up the cover from its opening. Thereafter, the cover is lifted upon the ground-engaging fulcrum 32 and then onto the wheels 29 and 31 for transport.

The U-shaped attachment 64 is secured within lifting arm projection 26'' by the thumb screw 38, FIG. 16, entering either of the adjusting holes 81' of its square section attaching block projection 81 extending rearwardly from its support plate 72 and rested flat upon the cover for the start of the lifting action by the hand lifting arm 26, FIG. 14. The foot lever device 51 will also be used in the initial lifting action by engagement with the cross body member 28 as illustrated in FIG. 10 to assist in the bodily lift of the full cover 60 by the bent upward handle 26.

With the continued lowering of the lifting arm 26, the weight of the cover is transferred to the wheels 29 and 31 of the tool so that the full cover will have been lifted from its opening and be bodily retained by the cover lifting tool so that it can be transported to any distant location.

For other types of covers, a different fitting will be used with the basic lifting arm tool 21 so that a cover can be grasped either from elongated holes or notches in the cover.

It should now be apparent that there has been provided a lifting tool for lifting heavyweight storm drain- and sewer covers from their openings. The operation is simple in that the tool itself once it has the appropriate fitting secured to it, is simply to hold the entire tool with its fitting extended in a vertical position over the top of the cover in a position for engaging its fitting with the elongated holes or notches of the cover and then simply pivot the tool over its forward depending fulcrum 32 to effect the final engagement with the cover and with continued lowering of tool onto the wheels 29 and 30 so that the cover can be bodily transported to a distant location. When it is desired to return the cover, the lifting tool will effect engagement with the cover at its place of storage in the same manner and the operation for engagement is the same whereby to lift the cover again for return to its opening. By the use of the U-shaped member 76 and the foot lever device 51 the cover 60 is easily popped free of its opening 61. The ground pivot 32 adds to the lifting advantage of the tool with the same being forwardly of the wheels and closer to the edge of the cover where the lifting action is most desirable and by the further use of the foot lever to increase the lever action. This tool not only can lift the cover from its opening, but can transport the same. Dependency is not made upon the wheels for the initial lifting action. The use of the depending ground fulcrum has been found most effective.

While various changes may be made in the detail construction, it shall be understood that such changes shall be within the spirit and scope of the invention as defined by the appended claims.

What is claimed is:

1. A sewer cover lifting tool comprising an elongated lifting arm, a cross-body connected to the forward end of the lifting arm and having supporting wheels journalled thereon; a depending fulcrum extending from the lifting arm for engagement with the ground to be effective for the initial lifting action close to the cover, a fitting attachment adapted with a sewer cover forward end of the lifting arm forwardly of the ground-engaging fulcrum and adapted for detachable engagement with edges of a sewer cover, said fitting attachment being so constructed as to have lifting engagement at one point on the sewer cover and dependent for further lifting engagement with the lifting arm at another point on the cover whereby the sewer cover will be bodily lifted from two points out of its opening when the lifting arm is lowered.

2. A sewer cover lifting tool as defined in claim 1 and said lifting arm having an upwardly bent handle portion.

3. A sewer cover lifting tool as defined in claim 1 and said fitting attachment including a T-shaft depending therefrom and adapted to extend through an elongated hole in a cover adjacent to its edge and with a transverse member engageable with undersurface of the cover with the turning of the lifting tool for its alignment of the T-element transverse member across the elongated hole to lift the cover from its opening and means on the lifting tool arm to be engaged by the edge of the cover, the cover being forwardly tilted so that the cover will be rigidly retained on the tool for bodily transport on its wheels.

4. A sewer cover lifting tool as defined in claim 2 and said fitting attachment being longitudinally adjustably fitted in the end of the lifting arm and means for retaining the fitting attachment in its adjusted position.

5. A sewer cover lifting tool as defined in claim 3 and said means on the lifting arm to receive the edge of cover plate being a stop plate fixed to the lifting arm and adapted to be engaged by the edge of the cover to provide for a point connection directly with the lifting arm while the attachment T-shaft retains the cover by its extension through the elongated hole in its cover for effecting the lifting action of the cover to thereby provide two points of connection so that the cover may be bodily lifted from its opening.

6. A sewer cover lifting tool as defined in claim 1 and a foot lever device pivoted upon the lifting arm forwardly of the cross-body member and engageable therewith upon being depressed by the foot to thereby effect additional lifting action of the tool.

7. A sewer cover lifting tool as defined in claim 1 and said fitting attachment being adapted for engagement with peripheral notches of a sewer cover, a secondary lifting arm pivoted upon the elongated lifting arm with a pin projection thereon and adapted to be lowered upon the cover and have a pin connection with diametrically-opposite notch of the cover, said lifting tool being operable to provide clamping engagement between said notched connection.

8. A sewer cover lifting tool as defined in claim 5 and said notch-engaging fitting having a U-shaped member freely slideable thereon adjacent to the cover for engagement with the sewer opening about the cover and a foot lever device carried by the elongated lifting arm and engageable with the U-shaped member to depress the same for engagement with the sewer opening to initially lift the cover therefrom.

9. A sewer cover lifting tool as defined in claim 5 and a foot lever device carried by the elongated lifting arm and engageable with the cross body member to augment the lifting action of the elongated lifting arm.

* * * * *